United States Patent [19]

Anthony et al.

[11] 4,162,898

[45] Jul. 31, 1979

[54] PROCESS FOR REMOVING SULFUR FROM COAL

[75] Inventors: Donald B. Anthony, Aurora; Allan V. Marse, Independence, both of Ohio

[73] Assignee: The Standard Oil Company, Cleveland, Ohio

[21] Appl. No.: 891,962

[22] Filed: Mar. 31, 1978

[51] Int. Cl.[2] ..... C10L 9/10; C10B 57/00

[52] U.S. Cl. ..... 44/1 R; 201/17

[58] Field of Search ..... 44/1 R; 75/6; 201/17

[56] References Cited

U.S. PATENT DOCUMENTS

| | | | |
|---|---|---|---|
| 52,699 | 2/1866 | Elward | 75/6 |
| 3,993,455 | 11/1976 | Reggel et al. | 44/1 R |

*Primary Examiner*—Carl Dees

*Attorney, Agent, or Firm*—John E. Miller, Jr.; Herbert D. Knudsen; Larry W. Evans

[57] ABSTRACT

Inorganic and organic sulfur are removed from coal by contacting the coal with gun blueing solution, namely an aqueous solution of sodium nitrate, sodium nitrite and sodium hydroxide.

8 Claims, No Drawings

PROCESS FOR REMOVING SULFUR FROM COAL

BACKGROUND OF THE INVENTION

The present invention relates to a novel chemical leaching process for significantly reducing the sulfur content of coal.

Processes for removing sulfur from coal by chemical leaching operations are well known. Examples of such processes are TRW's Meyer's process (U.S. Pat. No. 3,768,988) and Battelle's hydrothermal process.

Although each of these processes is capable of removing significant quantities of sulfur from coal, they each suffer significant disadvantages. For example, the TRW's Meyer's process is effective only in removing inorganic sulfur from coal. Moreover, the Battelle process is disadvantageous because high pressures and temperatures are required.

Accordingly, it is an object of the present invention to provide a novel process for removing sulfur from coal which is effective in removing both organic and inorganic sulfur and which can be carried out at comparatively low temperatures and pressures.

SUMMARY OF THE INVENTION

This and other objects are accomplished by the present invention which is based on the discovery that significant amounts of both organic and inorganic sulfur contained in coal can be removed therefrom by contacting the coal with an aqueous solution containing sodium nitrate, sodium nitrite and sodium hydroxide.

Thus, the present invention provides a process for removing sulfur from coal comprising contacting the coal with an aqueous solution containing sodium nitrate, sodium nitrite and sodium hydroxide.

DETAILED DESCRIPTION

In accordance with the present invention, both organic and inorganic sulfur contained in coal can be removed therefrom by chemically leaching the coal with an aqueous solution of sodium nitrate, sodium nitrite and sodium hydroxide.

The inventive process is applicable to all types of coal. In this regard, it is well known that the chemical composition of coals obtained from different locations can vary widely. The inventive process can be practiced on all types of coal, although the amount of desulfurization attainable varies with the particular coal being processed.

The coal to be treated by the inventive process can be of any size although it should be in particulate form since this increases the contact of the aqueous sulfite solution with the coal mass. Preferably, the particulate coal should have a particle size of no more than ⅛ inch since the efficiency of the process decreases at higher particle sizes. Below this value, however, it has been found that there is no particular criticality in the particle size of the coal, essentially the same results being obtained regardless of particle size. It is desirable, however, to avoid using coal of too fine a particle size, since as is well known, physical separation of extremely fine particles from an aqueous liquid can be difficult. Particle sizes above ⅛ inch, e.g. ¼ inch, can be used if desired, while particle sizes on the order of −325 mesh to ⅛ inch, more preferably about 60 mesh, have been found most convenient.

The leachant used to process coal in accordance with the present invention is an aqueous solution containing sodium nitrate, sodium nitrite, and a base, preferably sodium hydroxide. Such solutions have been used in the past to treat gun barrels and hence are known as "gun blueing solutions". The concentration of sodium nitrate, sodium nitrite and sodium hydroxide in the aqueous solution are not particularly critical and can vary over wide limits. Normally, the concentration of each of sodium nitrate and sodium nitrite should be between 0.1 normal and the saturation value and the concentration of sodium hydroxide should be between 1 and 12 normal in order that the sulfur removal capabilities of the leachant solution are significant. Any concentrations of sodium nitrate, sodium nitrite and sodium hydroxide within these ranges can be employed with facility. Preferably, the concentration of sodium nitrate is about 0.5 to 1 normal, the concentration of sodium nitrite is about 0.5 to 1 normal and the concentration of sodium hydroxide is about 5 normal. While higher concentrations of sodium nitrate, sodium nitrite and sodium hydroxide can be employed, no significant improvement in sulfur removal efficiency is obtained.

The leachant solution of course can contain other dissolved materials which do not interfere with the sulfur removal procedure as well as inert suspended materials, if desired.

The amount of leachant contacted with a given amount of coal is also not critical. As a practical matter, the coal/leachant ratio should be at least 1/20 in order for the process to be economic, although lower coal/leachant ratios can be employed if desired. Furthermore, when the coal/leachant ratio exceeds about 1.5/1, the mixture becomes too viscous. Therefore, it is preferable to operate with a coal/leachant ratio between about 1/20 to 1.5/1. Preferably the coal/leachant ratio is about 1/5.

The temperature at which the coal is contacted with the leachant can also vary widely. The process should be conducted at, near or above the boiling point of the leachant, which may be a few to 30 or more degrees Centigrade above the boiling point of water. Thus, it is preferred to carry out the process at a temperature of about 80°–400° C., most preferably 100°–150° C. Care should be taken not to operate at too high a temperature, however, since the coal organics begin to oxidize under these conditions. In the most preferred embodiment of the invention, the process is carried out under reflux conditions, i.e. the leachant is boiling and the vapors driven off the leachant through boiling are condensed and returned to the leachant.

The inventive process can be carried out at any pressure although atmospheric or slightly above atmospheric pressures are preferred. The contact time of the leachant with the coal necessary for significant sulfur removal varies depending on a number of factors such as the concentration of sodium sulfite in the leachant and the particular coal being processed. Normally, contact times on the order of ½ hour to 24 hours are employed.

When the leaching procedure is finished, the processed coal and the leachant are separated from one another. This can be accomplished by any convenient technique such as, for example, filtering.

The treated particulate coal recovered in this manner can be used as is. However, it has been found in accordance with a further feature of the present invention that additional amounts of sulfur can be removed from the coal by washing the coal with water preferably containing an acid. Although not wishing to be bound to any theory, applicants believe that as a result of the inventive leaching procedure, some of the sulfur in the coal is transformed into sulfates which as known have limited solubility in slightly basic solutions. Since the aqueous leachant is slightly basic, a portion of the sulfates tend to remain in the coal particles when they are separated from the leachant. By washing the coal particles with water, additional sulfur will be removed. And if the water wash is acidic, still more sulfur will be removed because of the greater solubility of sulfates in acidic solutions.

In carrying out an acid wash, any acid can be used, although hydrochloric acid is preferred. Also, it is preferred to avoid using nitric acid as this may oxidize the coal. The concentration of acid in the aqueous acidic wash solution is not critical, concentrations ranging from 1.0 to 6.0 normal being preferred as most convenient. Also, if an acid wash is used it is desirable to water wash the coal after the acid wash to remove the acid anions which may become entrained therein.

In a particularly preferred embodiment of the invention, the inventive process as discussed above is followed by a conventional float-sink operation. In this regard, it is a common commercial practice to process raw coal before it is sold to remove some of the ash content thereof. This is normally done by a density separation technique wherein ground raw coal is formed into a slurry of an appropriate liquid and agitated. This causes heavier inorganics in the coal, i.e. ash, to be separated from the remainder of the coal and fall to the bottom of the composition and the remainder of the coal to float to the top. Choice of the density of the liquid determines how mush ash is separated out from the remainder of the coal. Although many different liquids can be used such as, for example, carbon tetrachloride, it is conventional in commercial operations to employ water. The "apparent density" of the water can be varied either by charging air into the bottom of the composition or by conducting the procedure in an apparatus which the water continuously flows upwards in the treating vessel.

In accordance with the present invention, it has been found that inventive treatment process in addition to removing sulfur from the coal will cause additional loosening of the inorganic matrix of the coal in much the same way as a Group I or II metal salt loosens the inorganic matrix in the invention of commonly assigned application (attorney docket 5080). Thus, when coal treated to the inventive procedure is subjected to float-sinking, more ash than would otherwise be possible under a given set of conditions is removed from the coal. This, of course, causes the coal product produced by this procedure to have a higher heat value than the raw coal charged.

In order to more thoroughly illustrate the present invention, the following examples are presented.

EXAMPLE 1

50 grams of a Pittsburgh seam coal from the Ireland Mine, West Virginia, and containing 5.27 percent sulfur (2.05% pyritic/0.35 sulfate/2.87% organic) was ground to 40×60 mesh. The particulate coal so obtained was treated for 6 hours with an aqueous solution 0.8 N in sodium nitrate 0.4 N in sodium nitrite and 5 N in sodium hydroxide, the aqueous solution boiling at 134° C. under reflux. The coal was recovered by filtration, then washed in order with water, an aqueous solution of 2 N HCl and again with water. Product coal was analyzed and found to contain 2.70% sulfur (0.62 pyritic/0.07 sulfate/2.01 organic) which represents a 49% sulfur reduction. Moreover, the ash content of the coal was reduced from 10.6 to 7.7%.

EXAMPLES 2 to 10

The process of Example 1 was repeated using a number of different coals. The results obtained are set forth in the following Table I.

TABLE I

| | Coal Type | | | Sulfur Content in Coal | | | Percent Sulfur Removed | | | Heating Value BTU/# | |
|---|---|---|---|---|---|---|---|---|---|---|---|
| Example | Seam | Mine | State | Total | Pyrite | Organic | Total | Pyrite | Organic | Coal | Product |
| 2 | Pittsburgh #8 | Ireland | W. Va. | 4.26 | 1.67 | 2.11 | 63 | 68 | 52 | 12,795 | 13,898 |
| 3 | Indiana #5 | Old Ben #1 | Ind. | 4.41 | 1.93 | 2.24 | 38 | 70 | 10 | 12,308 | 13,487 |
| 4 | Illinois #6 | Old Ben #24 | Ill. | 2.41 | 0.81 | 1.57 | 9 | 58 | 0 | 13,240 | 13,949 |
| 5 | Indiana #5 | Old Ben #1 | Ind. | 3.06 | 0.88 | 1.83 | 8 | −76* | 25 | 12,791 | 12,680 |
| 6** | Pittsburgh #8 | Ireland | W. Va. | 5.69 | 3.46 | 2.15 | 51 | 73 | 17 | 12,979 | 13,461 |
| 7 | Ohio #5 | | Ohio | 2.90 | 1.44 | 1.42 | 13 | 35 | 0 | 13,151 | 13,197 |
| 8 | Ohio #6 | | Ohio | 2.37 | 0.53 | 1.74 | 0 | 0 | 0 | 13,195 | 13,331 |
| 9 | Ohio #8 | Belmont Pied | Ohio | 2.74 | 1.32 | 141 | 13 | 32 | 3 | 13,853 | 13,006 |
| 10 | Pittsburgh #8 | Ireland | W. Va. | 2.26 | — | — | 22 | — | — | | |

*Negative number means sulfur content increased rather than decreased.
**Leachant 14N in NaOH.

From the foregoing, it can be seen that the inventive process is capable of removing sulfur from a wide variety of different coals. Thus, the present invention is of significant value in reducing air pollution caused by the burning of coal. Also, because the coal product of the inventive process has (as illustrated by the examples) a higher heat value than the raw coal, the inventive process is further advantageous in producing a superior coal product.

Incidentally, although the experimental results above indicate that no sulfur was removed in Example 8, it is believed that in fact a small amount of sulfur was removed and that the results indicated are erroneous. In this connection, the measurement accuracy of the instruments employed to measure sulfur content in the examples are not very sensitive at very low levels of sulfur content.

Although only a few embodiments of the present invention have been described above, it should be appreciated that many modifications can be made without departing from the spirit and scope of the invention. For example, bases other than sodium hydroxide such as calcium hydroxide, can be employed in place of the sodium hydroxide. All such modifications are intended to be included within the scope of the present invention, which is to be limited only by the following claims.

We claim:

1. A process for removing sulfur from coal comprising contacting the coal with a leachant comprising an aqueous solution containing sodium nitrate, sodium nitrite and a base.

2. The process of claim 1 wherein said base is sodium hydroxide.

3. The process of claim 2 wherein said leachant is heated to reflux during contact with said coal.

4. The process of claim 2 wherein said coal is particulate in form, substantially all of said coal having a particle size of no larger than ⅛ inch.

5. The process of claim 4 wherein said leachant is at least 0.1 normal in sodium nitrate, 0.1 normal in sodium nitrite and 1 normal in sodium hydroxide.

6. The process of claim 5 further comprising separating said particulate coal from said aqueous leachant and thereafter washing said particulate coal with water.

7. The process of claim 6 wherein said water contains an acid.

8. The process of claim 7 further comprising separating said particulate coal from the acid-containing water and thereafter washing said particulate coal with water.

* * * * *